US006233942B1

(12) United States Patent
White

(10) Patent No.: US 6,233,942 B1
(45) Date of Patent: May 22, 2001

(54) CONDENSING TURBINE

(75) Inventor: William Peter White, Tucson, AZ (US)

(73) Assignee: Thermaldyne LLC, Seattle, WA (US)

( * ) Notice: Subject to any disclaimer, the term of this patent is extended or adjusted under 35 U.S.C. 154(b) by 0 days.

(21) Appl. No.: 09/353,933

(22) Filed: Jul. 15, 1999

(51) Int. Cl.[7] ..... F01K 1/00
(52) U.S. Cl. ..... 60/670; 415/170.1; 415/202
(58) Field of Search ..... 60/670; 415/202, 415/92, 170.1, 174.2

(56) References Cited

U.S. PATENT DOCUMENTS

| | | | | |
|---|---|---|---|---|
| 509,644 | | 11/1893 | Bardsley . | |
| 1,137,704 | | 4/1915 | Dake . | |
| 1,179,078 | | 4/1916 | Dake . | |
| 2,378,740 | | 6/1945 | Viera . | |
| 3,372,906 | * | 3/1968 | Griffith | 415/202 X |
| 3,879,949 | | 4/1975 | Hays . | |
| 4,027,995 | * | 6/1977 | Berry | 415/202 X |
| 4,087,261 | | 5/1978 | Hays . | |
| 4,339,923 | | 7/1982 | Hays . | |
| 4,391,102 | | 7/1983 | Studhalter . | |
| 4,511,309 | | 4/1985 | Maddox . | |
| 5,385,446 | | 1/1995 | Hays . | |

* cited by examiner

*Primary Examiner*—Hoang Nguyen
(74) *Attorney, Agent, or Firm*—Holme Roberts & Owen LLP

(57) ABSTRACT

The preferred embodiment of the disclosed condensing turbine is characterized by its tolerance to fully condensing working fluid vapor and a unique geometry that uses a naturally developed centrifugal force, generated by the working fluid, along with an integral positive displacement pump, to return the working fluid to a vapor generator in a high pressure liquid state. Thus, with the working fluid exiting the turbine in a highly pressurized liquid state rather than a low pressure vapor state, the requirement for a conventional condenser, condensate pump and boiler feed pump is eliminated. This unique combination of turbine and positive displacement pump, exemplified by the present invention, allow the closed-loop vapor cycle turbine engine to become very compact and, thus, practical for automotive and aerospace use.

8 Claims, 2 Drawing Sheets

CONDENSING TURBINE

BACKGROUND OF THE INVENTION (1) Field of the Invention

The present invention relates to a closed-loop, vapor cycle, turbine systems that generate rotational power by absorbing energy from a high velocity, vaporized, working fluid.

(2) Description of Related Art

Power generation by vapor cycle turbine engines, using steam or other fluid vapors under pressure, has been a common practice for many decades. Systems having such turbine engines are typically comprised of a vapor generator for vaporizing the working fluid, a turbine, responsive to the vaporized working fluid produced by the vapor generator and producing work, and a condenser for condensing the expanded vaporized working fluid exhausted from the turbine and producing condensate that is returned to the vapor generator by a pump.

The turbines in practical use are typically of the impulse or reaction type and are divided into two broad categories, axial and radial flow. Both axial and radial flow turbines require a high quality, high velocity vapor which is distributed to the blades found in the turbine structure. For these bladed turbines, variations of vapor density result in an unbalanced mass flow passing through the rotating turbine which is undesirable for engine operation.

The drag turbine is a less common category of impulse turbine of which there are two general variations. In the first, high velocity vapor is directed, by a nozzle, to flow radially from the outer edge of a series of uniformly spaced, smooth disks compelling them to rotate about a central axis through the action of viscous drag. In a second variation, high velocity vapor is directed, by a nozzle, to flow tangentially against the smooth outer or inner surface of a cylindrical structure compelling it to rotate about a central axis, again, through the action of viscous drag. Both types of drag turbine do not require uniformly distributed flow and are highly tolerant of low quality vapor.

For bladed turbines, variations of vapor density result in an unbalanced mass flow which creates vibration that can lead to catastrophic failure of the turbine and its associated support structure. The variations of vapor density are attributable to variations in vapor quality localized within the vapor flow. Liquid droplets contained within a low quality vapor cause surface erosion of the delicate turbine blades. The erosion shortens the useful life of the blades and results in the turbine becoming statically unbalanced. Therefore, to achieve maximum life from a bladed turbine, the working fluid vapor entering and exiting the turbine must be in a high quality, non-condensing state. In a conventional closed loop power cycle, a condenser must be used to eject the latent heat of vaporization from the working fluid, returning the fluid to the liquid state for reuse in the cycle.

For a closed loop power system employing a bladed turbine, the necessity of a high quality vapor requires that the condenser eject a larger amount of waste heat from the vapor than would be required if the turbine could tolerate a low quality, condensing vapor flow. The requirement of the condenser to eject this larger amount of waste heat, results in a reduction of the overall thermal efficiency of the engine. Furthermore, the physical size and weight of the condenser, along with its associated pumps and plumbing, is a major impediment to the use of the closed loop power system in automotive and aerospace applications. Size, weight and overall thermal efficiency are principal design considerations in power systems developed for these applications.

Therefore, what is needed, and what the present invention provides, is a means such that the working fluid exiting the turbine is in the fully condensed liquid state. Employing such means returns the working fluid vapor to the liquid state within the turbine and entirely eliminates the need for a heat exchange condenser, and its associated pumps and plumbing.

Accordingly, the inventive turbine is able to tolerate a fully condensing working fluid flow while providing a unique mechanism, for returning the working fluid to the vapor generator without the need of a condenser or additional pumps.

BRIEF SUMMARY OF THE INVENTION

The practical application of the closed-loop vapor cycle turbine engine to automotive and aerospace use has long been excluded from consideration due to the inability to package the power plant in a compact form. A principle limiting element to achieving a compact form is the requirement for a condenser. For many vapor cycle power systems in common use, the condenser has a physical size greater than the balance of the whole system. What is needed, and what the present invention provides, is a turbine to smoothly transform the kinetic energy of fully condensing working fluid vapors into rotary power while concurrently acting as a positive displacement pump for returning the working fluid, in the liquid state and under high pressure, to the vapor generator.

In the present invention, a fully condensing working fluid vapor is directed by a nozzle along the inner surface of a cylinder that is free to rotate about its central axis. The working fluid, upon contact with the surface of the cylinder, imparts its kinetic energy to the cylinder through the mechanism of viscous drag and, under the influence of centrifugal force, readily returns to the liquid state.

The outer surface of the cylinder is provided with one or more vane-type seals in contact with an outer housing that encompasses the inventive turbine. The outer housing is provided with one or more stationary vane-type seals acting upon the outer surface of the cylinder. These seals form, in combination, the pumping cavities of a positive displacement rotary vane pump. The necessary flow passages to and from the created pumping cavities are also provided.

This unique combination of an impulse drag turbine and a positive displacement pump, exemplified by the present invention, allow the closed-loop vapor cycle turbine engine to become very compact and, thus, practical for automotive and aerospace use. Other objects, advantages and novel features of the present invention will become apparent from the following detailed description of the invention when considered in conjunction with the accompanying drawings.

DETAILED DESCRIPTION OF THE ILLUSTRATED EMBODIMENT

Figure 1:
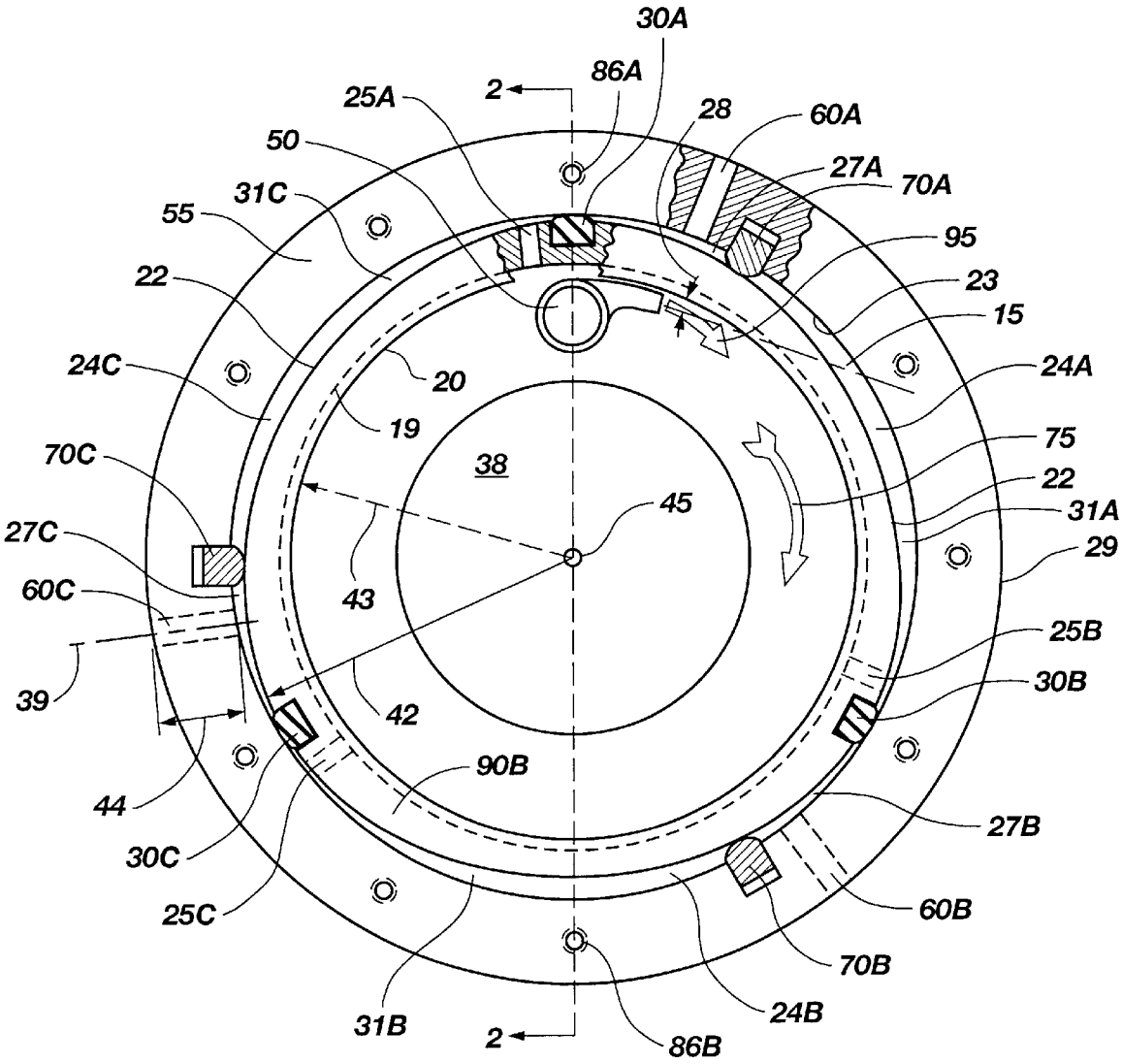
FIG. 1 is a cross sectional simplified depiction of a turbine of the present invention.
Figure 2:
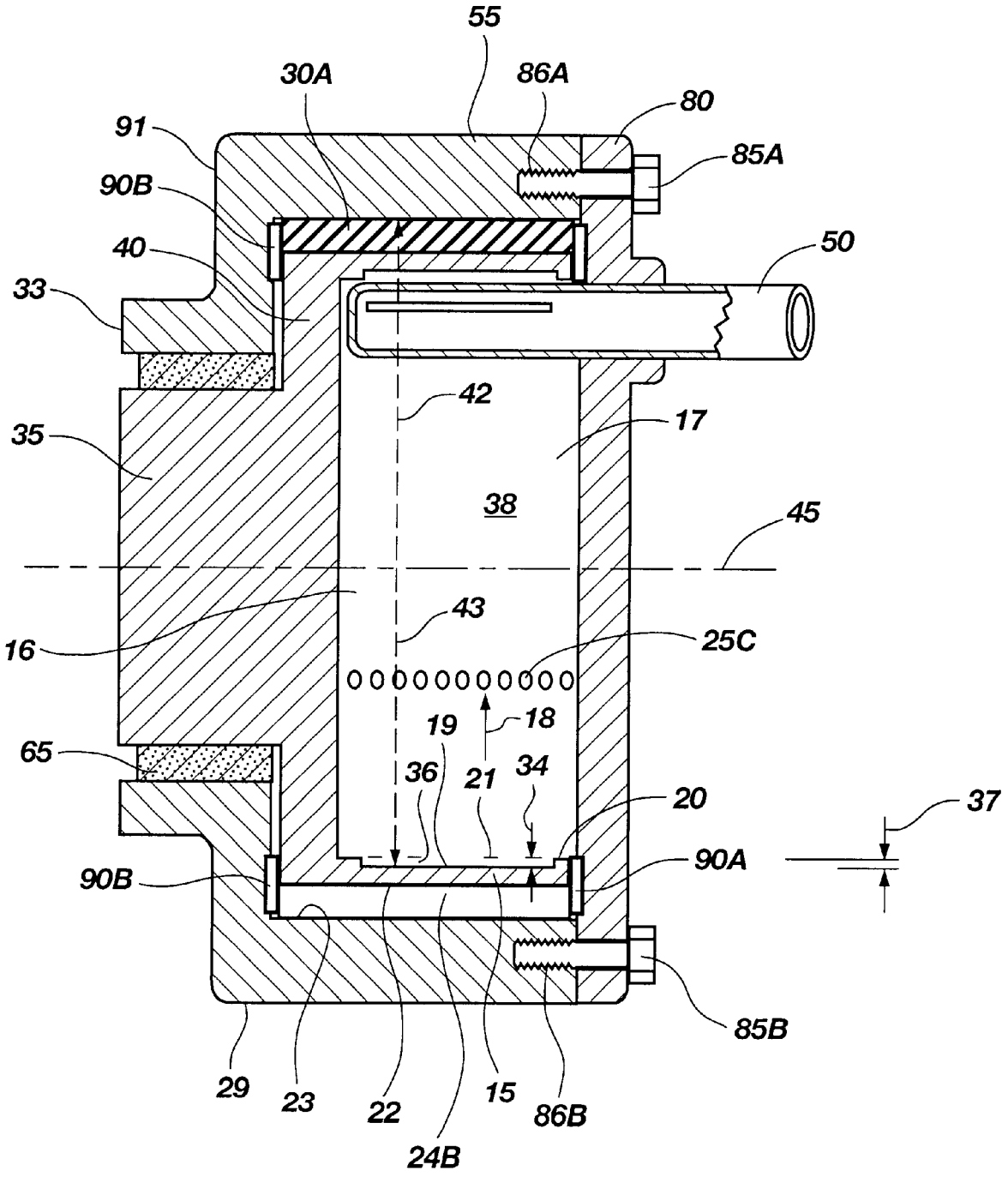
FIG. 2 is a cross section view taken on the line 2—2 of FIG. 1.

Referring to FIGS. 1 and 2, the preferred embodiment is illustrated. The turbine 10 of the present invention has a hollow rotatable member such as turbine drum 15 which is free to rotate in a direction 75 about its longitudinal axis 45 which is the axis of rotation of the turbine drum 15. One end 16 of the turbine drum 15 is closed with a hub 40 and provided with a co-axial output shaft 35 which functions to support the turbine drum 15 within a suitable housing 55 and as an output for useful work. The opposite end 17 of the turbine drum 15 is open and provided with a small lip 20 that extends radially inward 18 from the interior surface 19 of the turbine drum 15. The combination of the hub 40, turbine drum 15 and lip 20 form a cylindrical channel 21 on the interior surface of the turbine drum 15.

The exterior surface 22 of the turbine drum 15 incorporates one or more drum seals 30 that are arranged parallel to the longitudinal axis 45 of the turbine drum 15. The drum seals 30A, 30B and 30C are in combination with the turbine drum 15. In FIG. 1, it can be seen that three drum seals 30A, 30B and 30C are shown spaced 120 degrees apart radially around the outer surface 22 of the turbine drum 15. The turbine housing 55 has stationary seals 70A, 70B and 70C also spaced 120 degrees apart radially about the interior surface 23 of the turbine housing 55. Side seals 90A and 90B are shown positioned between the turbine drum 15 and the end plate 80 which is held to the turbine housing 55 by a plurality of radially spaced bolts such as bolts 85A and 85B that thread into corresponding bolt holes such as bolt holes 86A and 86B. Side seals 90A and 90B are shown positioned to between the hub 40 and the shoulder 91 of the turbine housing 55, the stationary seals 70A, 70B and 70C, the pump side seals 90A and 90B and the turbine housing 55, form the annular chambers 24A, 24B and 24C of a vane-type positive displacement pump. The turbine drum 15 is shown having a cylindrical hollow interior 39 with an interior surface circular in cross section. The turbine drub 15 also has a non cylindrical exterior surface 22 which has major radius 42 and a minor radius 43.

Fluid passages 25A, 25B and 25C, located near each of the drum seals 30A, 30B and 30C are formed, through the turbine drum 15. The fluid passageways 25A, 25B and 25C are passageways that connect the cylindrical channel 21 on the interior surface 19 of the turbine drum 15 to the suction sides 31A, 31B and 31C of the drum seals 30A, 30B and 30C. Fluid outlet ports 60A, 60B and 60C are formed in the turbine housing 55 to extend from the inner surface 23 to the exterior surface 29, located near the stationary seals 70A, 70B and 70C and through the turbine housing 55, creates a passageway for the high pressure fluid that develops between the stationary in the chambers 27A, 27B and 27C seals 70A, 70B and 70C and the drum seal seals 30A, 30B and 30C.

As with any turbine, a nozzle 50 is provided which directs the flow of the fully condensing working fluid vapor. For the present invention, the direction of working fluid flow 95 is such that the working fluid impinges upon the interior surface 19 of the turbine drum 15 normal to its longitudinal axis 45 and at a shallow angle of incidence 28. Also, the turbine housing structure which incorporates a fluid outlet port 60 for the pump element of the invention, as well as, all has a bearing support portion 33 to retain the and shaft support bearings 65 which provide support and control the leakage of working fluid along the shaft 35. In the preferred embodiment, end plate 80 supports the nozzle 50 The end plate 80 is held to the housing 55 by a plurality of attachment bolts 85.

The interior surface of the turbine drum 15 is maintained at a constant pressure by the introduction of working fluid by the nozzle 50 on the interior surface 19 while it is turning at a high rate of rotational speed. The pressure developed by the working fluid on the interior surface 19 of the turbine drum 15 is a function of rotational speed, working fluid density and the radial thickness 34 of the working fluid layer 36. Undisturbed, the working fluid layer 36 has no velocity relative to the turbine drum 15 and, being held in place by centrifugal force, has a radial thickness 34 equal to the radial thickness 37 of the lip 20 located at the opposite end 17 of the turbine drum 15. The fluid pressure developed is, by design, greater than the vapor pressure of the working fluid vapor being supplied by the nozzle 50. With the above conditions met, the high relative velocity, low density working fluid vapor directed by the nozzle 50 against the interior surface 19 and layer 36, will condense into a high velocity, high density liquid. Condensation is further promoted by the centrifugal force generated on this working fluid as it is being forced to travel in the tight circular path imposed by the interior surface 19 of the turbine surface.

In a vortex, such as the one created within the turbine drum 15 by the introduction of working fluid vapor from the nozzle 50, the higher energy fluid particles naturally move to the outermost radial distance from the center of the vortex. In doing so, lower energy fluid particles within the working fluid layer are displaced radially inward. The higher energy working fluid liquid nearest the turbine drum 15 inner surface loses its forward momentum, dissipated through viscous drag, until its forward velocity is equal to that of the turbine drum 15 inner surface. The generated viscous drag imparts a shear force to the turbine drum 15 inner surface, which causes the turbine drum 15 to turn about its longitudinal axis 45 and in the direction of working fluid flow 95.

The working fluid liquid exits the interior 38 of the turbine drum 15 through the provided fluid passage 26. In the preferred embodiment of the invention, the fluid passages 25A, 25B and 25C have a length 44 and an axis 39 which is normal to the working fluid flow path created as it exits from the nozzle 50. This geometry creates a restriction in the fluid flow path, such that the working fluid exiting the interior 38 of the turbine drum 15 is generally limited to that portion of the working fluid which has expended the maximum amount of its kinetic energy.

Due to the rotation of the turbine drum 15, the drum seals 30A, 30B and 30C are concurrently moving toward and away from the stationary seals 70A, 70B and 70C as they travel their circular paths within the turbine housing 55. Within the chambers 31A, 31B and 31C formed by the drum seals 30A, 30B and 30C as they move away from the stationary seals 70A, 70B and 70C a suction is created that the working fluid liquid, aided by centrifugal force, is compelled to fill by flowing through the fluid passages 25A, 25B and 25C. In the chambers 27A, 27B and 27C on the sides of the drum seals 30A, 30B and 30C that are moving toward the stationary seals 70A, 70B and 70C, the working fluid liquid is compelled, by positive displacement by the drum seals 30A, 30B and 30C, to flow through the fluid outlet ports 60A, 60B and 60C under high pressure. The cycle of suction and displacement is repeated each time the drum seals 30A, 30B and 30C and stationary seals 70A, 70B and 70C pass each other during the course of rotation of the turbine drum 15.

As can be seen from the preceding description, the inventive turbine provides a means to smoothly transform the kinetic energy of high velocity, fully condensing working fluid vapor into rotary power while concurrently acting as a positive displacement fluid pump. The primary advantage of this invention is to provide a means for the elimination of the condenser required by typical closed-loop vapor cycle turbine engines. Thus, engines made in accordance with the invention will be compact compared to those of comparable power using a condenser; and therefore, such engines will be practical for automotive and aerospace use.

Although the description above contains many specificity's, these should not be construed as limiting the scope of the invention. The description of the invention merely provides illustrations of the presently preferred embodiment of the invention. An example of another embodiment would be the use of In other embodiments, surface enhancements on the inner surface 19 of the turbine drum 15. These surface enhancements may take the form of stipples, grooves or channels designed to promote or reduce turbulence within the working fluid or to simply increase the inner surface 19 of the turbine drum 15. Furthermore, the surface enhancement may take the form of a metallic or ceramic coating to provide erosion protection to the turbine drum 15. In another embodiment, the pump side seals 90A and 90B may be eliminated by configuring the turbine by using the turbine housing 55 and end plate 80 to perform this function. In yet other embodiments, means for cooling the turbine may be provided. Also, a vapor generator may be connected to receive working fluid from the fluid outlet ports 60A, 60B and 60C and supply the working fluid as a vapor to the nozzle 50. Also a surface hardening means may be applied to the interior surface of the drum and to the exterior surface of the drum. Accordingly, the scope of the invention should not be determined by the embodiment illustrated, but by the appended claims and their legal equivalents.

What is claimed is:

1. A combination of a condensing turbine and pump, said combination comprising:

a. a hollow drum having a longitudinal axis, an interior, an interior surface and an exterior surface, said hollow drum being configured to rotate about said longitudinal axis;

b. nozzle means for directing a working fluid vapor toward said interior surface to urge said drum to rotate about said longitudinal axis;

c. housing means for containing and rotatably supporting said hollow drum, said housing means being spaced from said exterior surface of said hollow drum to define an annular zone;

d. first seal means connected to said exterior surface and sized to extend through said annular zone toward said housing means for effecting a seal between said exterior surface and said housing means;

e. second seal means connected to said housing means and sized to extend through said annular zone toward said exterior surface of said hollow drum for effecting a seal between said housing means and said exterior surface and for forming an inlet chamber between said second seal means and said first seal means in the direction of rotation of said hollow drum and an outlet chamber between said second seal means and said first seal means opposite to the direction of rotation of said hollow drum;

f. a first fluid passageway formed to extend between said interior to said exterior surface of said hollow drum proximate to said first seal means for communicating a working fluid from said interior into said inlet chamber;

g. a second fluid passageway formed to extend through said housing means proximate to said second seal means for communicating said working fluid from said outlet chamber to exterior of said housing means; and h. transfer means attached to and extending from said hollow drum for transmitting rotational torque created by said working fluid urging said hollow drum to rotate.

2. A turbine comprising:

a hollow rotatable member having an axis of rotation, an interior, an interior surface and an exterior surface, said hollow rotatable member being configured to rotate about said axis of rotation;

nozzle means positioned to extend into said interior of said hollow rotatable member, said nozzle means being positioned to direct a working fluid toward said interior surface to urge said hollow rotatable member to rotate about said longitudinal axis;

housing means for containing and rotatably supporting said hollow rotatable member, said housing means having said hollow rotatable member positioned therein spaced from said exterior surface of said hollow rotatable member to define a chamber therebetween;

first seal means connected to said hollow member and sized to extend from said exterior surface through said chamber to said housing means for effecting a seal against said housing means;

second seal means connected to said housing means and sized to extend through said chamber to said exterior surface of said hollow rotatable member for effecting a seal against said exterior surface and for dividing said chamber into an inlet chamber positioned between said second seal means and said first seal means in the direction of rotation of said hollow rotatable member and an outlet chamber positioned between said second seal means and said first seal means opposite to the direction of rotation of said hollow rotatable member;

a first fluid passageway means formed in said hollow rotatable member to extend between said interior and said exterior surface for communicating the working fluid from said interior into said inlet chamber;

a second fluid passageway means formed to extend through said housing means for communicating the working fluid from said outlet chamber to exterior of said housing means; and transfer means attached to and extending from said hollow rotatable member for transmitting rotational torque created by said working fluid urging said hollow rotatable member to rotate.

3. The turbine of claim 2 wherein said nozzle is configured to direct said working fluid in vapor form against said interior of said hollow rotatable member.

4. The turbine of claim 3 wherein said first seal means is a plurality of rotating seals, and wherein said second seal means is a plurality of fixed seals which define a corresponding plurality of inlet chambers and a corresponding plurality of outlet chambers.

5. The turbine of claim 3 wherein said first seal means is three rotating seals and wherein said second seal means is three fixed seals each of which define three inlet chambers and three outlet chambers.

6. The turbine of claim 5 wherein said interior surface of said hollow rotating member is cylindrical.

7. The turbine of claim 6 wherein said exterior surface of said hollow rotating member is non cylindrical with at least one portion having a major radius and a portion adjacent thereto having a minor radius.

8. The turbine of claim 6 wherein said exterior surface of said hollow rotating member is non cylindrical with three spaced apart major portions each having a major radius and three minor portions each interspaced between two major portions, said minor portions each having a minor radius which is less than said major radius.

* * * * *